US009870760B2

(12) United States Patent
Chervitz

(10) Patent No.: US 9,870,760 B2
(45) **Date of Patent: *Jan. 16, 2018**

(54) MUSICAL INSTRUMENT

(71) Applicant: STRAWBONE LLC, Chesterfield, MO (US)

(72) Inventor: Randy J Chervitz, St. Louis, MO (US)

(73) Assignee: STRAWBONE LLC, Chesterfield, MO (US)

( * ) Notice: Subject to any disclaimer, the term of this patent is extended or adjusted under 35 U.S.C. 154(b) by 114 days.

This patent is subject to a terminal disclaimer.

(21) Appl. No.: 15/204,660

(22) Filed: Jul. 7, 2016

(65) Prior Publication Data

US 2016/0322037 A1 Nov. 3, 2016

Related U.S. Application Data

(63) Continuation-in-part of application No. 14/304,697, filed on Jun. 13, 2014, now Pat. No. 9,495,943, and a continuation-in-part of application No. 13/853,736, filed on Mar. 29, 2013, now Pat. No. 9,105,258.

(51) Int. Cl.
*G10D 7/02* (2006.01)

(52) U.S. Cl.
CPC ..... *G10D 7/02* (2013.01)

(58) Field of Classification Search
CPC G10D 7/00; G10D 9/00; G10D 9/043; G10D 7/026; G10D 7/04; G10D 3/00; G10K 5/00; A01M 31/004
USPC ..... 84/330, 380 R
See application file for complete search history.

(56) References Cited

U.S. PATENT DOCUMENTS

| | | | | |
|---|---|---|---|---|
| 2,485,142 | A | 10/1949 | Duncan | |
| 4,121,835 | A | 10/1978 | Garabedian | |
| 6,129,292 | A | 10/2000 | Leung et al. | |
| 9,293,121 | B2 * | 3/2016 | Chervitz | G10D 7/02 |

OTHER PUBLICATIONS

Tub Tunes Water Whistle toy display card, copyright notice year date 2006.

* cited by examiner

*Primary Examiner* — Kimberly Lockett
(74) *Attorney, Agent, or Firm* — David H. Chervitz

(57) ABSTRACT

A musical instrument is disclosed which has a first tubular member having an inlet end and an outlet end, an interior surface, and an exterior surface, a second tubular member having an inlet end and a closed end having a one-way valve, the second tubular member adapted for receiving the first tubular member for moving the first tubular member relative to the second tubular member, and the second tubular member for receiving a liquid through the one-way valve, and a stopper having an opening, the stopper for being inserted in the inlet end of the second tubular member and the opening for receiving the first tubular member there through.

20 Claims, 4 Drawing Sheets

MUSICAL INSTRUMENT

CROSS REFERENCE TO RELATED APPLICATIONS

This application is a continuation-in-part of U.S. patent application Ser. No. 14/304,697 filed on Jun. 13, 2014, now U.S. Pat. No. 9,495,943, which was a continuation-in-part of U.S. patent application Ser. No. 13/853,736 filed on Mar. 29, 2013, now U.S. Pat. No. 9,105,258.

BACKGROUND

This disclosure relates generally to a musical instrument, and more particularly to a musical instrument that is capable in generating various musical notes or tones and also functions as a straw.

Musical instruments, such as percussion instruments, wind instruments, and string instruments, are well known. In particular, musical instruments operate by producing a vibration that can be perceived by a human ear as an audible sound and interpreted as a musical note or composition. In order to produce a musical note, the musical instrument must be able to produce a vibration and sometimes amplify the vibration. All musical instruments have a sound generating mechanism that is capable of producing musical notes. For example, a drum head may be struck to produce a vibration or a string may be plucked to produce a vibration. Although such instruments are known, learning how to play and master such instruments can be a time consuming and frustrating endeavor. Further, some musical instruments are very large and are difficult to move from location to location. This may reduce the ability of a musician to practice the instrument. Other musical instruments are very expensive and may not be rented due to their expense. The expense of the instrument may hinder a musician from learning to play the instrument. In view of this, there is always a need to develop a musical instrument that is easy to learn how to play, inexpensive, and of a compact design.

The present disclosure is designed to obviate and overcome many of the disadvantages and shortcomings experienced with prior musical instruments. Moreover, the present disclosure is related to a musical instrument that can be easily manipulated or played to produce various musical notes. The musical instrument of the present disclosure is also simple to learn how to play due to the size of the musical instrument and the nature of the musical instrument. The present disclosure is also directed to a musical instrument that also functions as a straw to drink through the musical instrument.

SUMMARY

In one form of the present disclosure, a musical instrument is disclosed which comprises a first tubular member having an inlet end and an outlet end, an interior surface, and an exterior surface, a second tubular member having an inlet end and a closed end having a one-way valve, the second tubular member adapted for receiving the first tubular member for moving the first tubular member relative to the second tubular member, and the second tubular member for receiving a liquid through the one-way valve, and a stopper having an opening, the stopper for being inserted in the inlet end of the second tubular member and the opening for receiving the first tubular member there through.

In another form of the present disclosure, a musical instrument comprises a first tubular section having an inlet end and an outlet end, an interior surface, and an exterior surface, a first tubular member having an inlet end and a closed end portion having a one-way valve positioned at the closed end portion, the first tubular member adapted for receiving the first tubular section for moving the first tubular section relative to the first tubular member to generate a musical note when air is blown by the inlet end of the first tubular section, and the one-way valve for allowing a liquid to be drawn into and through the first tubular member, and a stopper assembly having an opening, the stopper for being inserted on the inlet end of the second tubular member and the opening for receiving the first tubular member there through.

In still another form of the present disclosure, a musical instrument comprises a first tubular member having an inlet end, an outlet end, and a first length, a second tubular member having an inlet end, an outlet end, and a second length with the second length being different than the first length, a third tubular member having an inlet end and a closed end having a one-way valve, the third tubular member adapted for receiving the first tubular member or the second tubular member for moving the first tubular member or the second tubular member relative to the third tubular member, and the one-way valve for allowing a liquid to be drawn into the third tubular member, and a stopper member having an opening, the stopper for being inserted on the inlet end of the third tubular member and the opening for receiving the first tubular member or the second tubular member there through.

In light of the foregoing comments, it will be recognized that the musical instrument of the present disclosure is of simple construction and design and which can be easily employed with highly reliable results.

The present disclosure provides a musical instrument that has an inner tubular member that can be displaced relative to an outer tubular member that is operable to produce various musical notes or sounds.

The present disclosure provides a musical instrument that is capable of generating various musical sounds to provide a wide variety of musical notes or compositions.

The present disclosure provides a musical instrument that is lightweight and compact.

The present disclosure also provides a musical instrument that has one moving part which is used to generate musical notes.

The present disclosure further provides a musical instrument that is compact and may easily be carried, stored, transported, inventoried, and operated.

The present disclosure provides a musical instrument that can be constructed using readily available materials.

The present disclosure also provides a musical instrument that is inexpensive and capable of being used at least once.

The present disclosure is further directed to a musical instrument that can function as a straw to allow a liquid to be drawn through the musical instrument for drinking purposes.

The present disclosure further provides a musical instrument that is a combination of a musical instrument and a straw which can function simultaneously as both a musical instrument and a straw when a liquid is in the musical instrument.

These and other advantages of the present disclosure will become apparent after considering the following detailed specification in conjunction with the accompanying drawings, wherein:

DETAILED DESCRIPTION OF THE PREFERRED EMBODIMENTS

Figure 1:
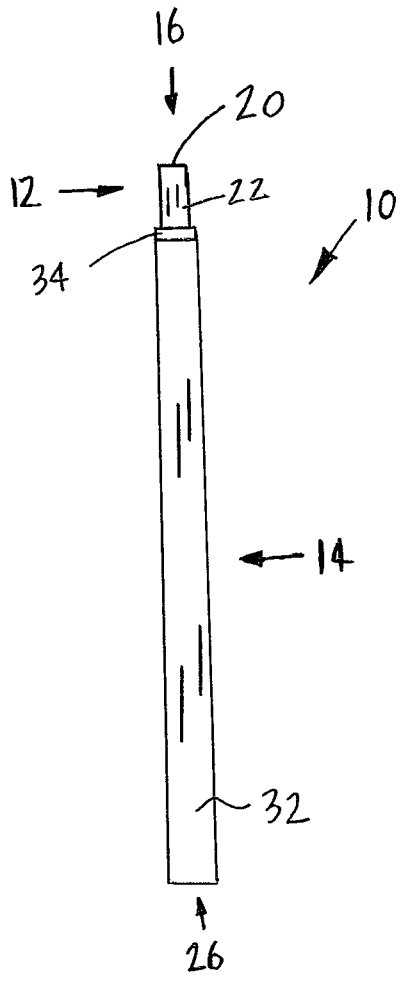
FIG. 1 is a perspective view of a musical instrument constructed according to the present disclosure.
Figure 2:
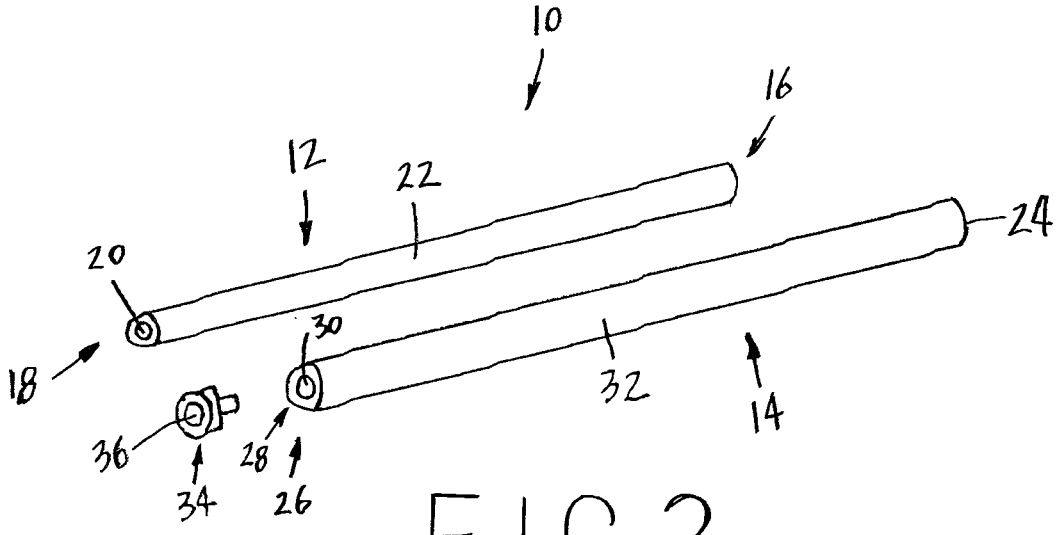
FIG. 2 is a perspective view of the musical instrument constructed according to the present disclosure shown in a disassembled state.

Referring now to the drawings, wherein like numbers refer to like items, number 10 identifies a preferred embodiment of a musical instrument constructed according to the present disclosure. Referring now to FIGS. 1 and 2, the musical instrument 10 is shown to comprise a first inner tubular member or section 12 that is adapted to be inserted into a second outer tubular member 14. The first tubular member 12 has an inlet end 16, an outlet end 18, an interior surface 20, and an exterior surface 22. The second tubular member 14 has an inlet end 24 and a closed end or portion 26 having a one-way valve 28. The second tubular member 14 also has an interior surface 30 and an exterior surface 32. A stopper 34 having an opening 36 is inserted in the inlet end 24 of the second tubular member 14. The opening 36 is used to receive the first tubular member 12 there through. The stopper 34 is used to form a closed container formed by the stopper 34, the second tubular member 14, and the closed end 26. The stopper 34 and the closed end 26 help to create a vacuum to facilitate drawing a liquid through the closed end 26 into the musical instrument 10. The second tubular member 14 has the closed end 26 to stop movement of the first tubular member 12 when inserted therein. The one-way valve 28 allows the musical instrument 10 to be used as a straw when the closed end 26 is inserted into a liquid container (not shown) such as a glass or mug. Examples of the one-way valve 28 include a duckbill valve, a check valve, a ball check valve, a diaphragm check valve, or any valve that allows a liquid free flow in one direction while blocking flow of a liquid in an opposite direction. When a liquid is placed in the second tubular member 14 and the first tubular member 12 is inserted therein, the musical instrument 10 may be operated or played. In particular, the first tubular member 12 may be moved relative to the second tubular member 14 and a player may blow air by or into the inlet end 16 to produce a musical note. By moving the first tubular member 12 relative to the second tubular member 14 various other musical notes may be generated or produced. The first tubular member 12 is also centered in the second tubular member 14. A liquid inserted into the second tubular member 14 acts as a lubricant to facilitate movement of the first tubular member 12 relative to the second tubular member 14. Further, it is possible and contemplated that the musical instrument 10 may be played without any liquid being in the second tubular member 14. In this manner, the musical instrument 10 is operated by a player blowing air by or into the inlet end 16 to produce a musical note. Movement of the first tubular member 12 relative to the second tubular member 14 while blowing air by or into the inlet end 16 will generate various musical notes, tunes, or songs. The exterior surface 22 of the first tubular member 12 is engage in the opening 36 of the stopper 34.

The first tubular member 12 has a length and the second tubular member 14 has a length. Typically, the length of the first tubular member 12 is longer or greater than the length of the second tubular member 14. This allows the first tubular member 12 to extend out of the inlet end 24 of the second tubular member 14. This also provides for easy grasping or handling of the first tubular member 12 relative to the second tubular member 14. It is also possible and contemplated that the length of the first tubular member 12 is smaller or less than the length of the second tubular member 14 or equal to the length of the second tubular member 14.

Figure 3:
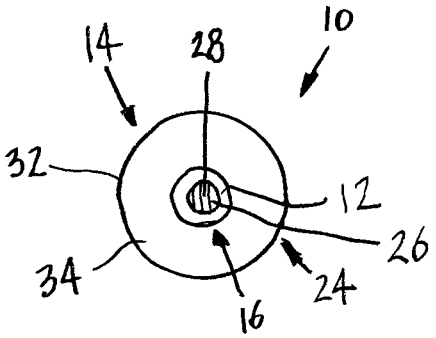
FIG. 3 is an inlet end view of the musical instrument constructed according to the present disclosure.

FIG. 3 illustrates an inlet end view of the musical instrument 10. The musical instrument 10 is shown to comprise the first tubular member 12 inserted into the second tubular member 14 through the stopper 34. The first tubular member 12 has the inlet end 16 extending out of the stopper 34. The second tubular member 14 has the stopper 34 inserted into the inlet end 24. The exterior surface 32 of the second tubular member 14 is also shown. Although obscured in this particular view, it should be appreciated that the exterior surface 22 of the first tubular member 12 may engage the stopper 34. The closed end 26 and the one-way valve 28 are also visible through the inlet end 16 of the first tubular member 12. The first tubular member 12 has a diameter and the second tubular member 14 has a diameter. As can be appreciated, the diameter of the first tubular member 12 is less than the diameter of the second tubular member 14. This allows the first tubular member 12 to fit within the second tubular member 14. The diameters of the first tubular member 12 and the second tubular member 14 are generally circular in shape or cross-section. As should be further appreciated, the diameter of the first tubular member 12 is less than the diameter of the opening 36 of the stopper 34. The first tubular member 12 has a thickness and the second tubular member 14 has a thickness. The thicknesses may be the same or different.

Figure 4:
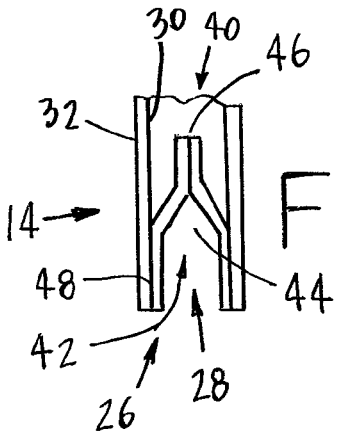
FIG. 4 is a partial cross-sectional view of a closed end of a tubular member having a one-way valve installed therein constructed according to the present disclosure.

With particular reference now to FIG. 4, a cross-sectional view of the closed end 26 having the one-way valve 28 positioned within the second tubular member 14 is depicted. The one-way valve 28 is shown to be a duckbill valve 40 having an inlet end 42, a central body portion 44, and an outlet end 46. The valve 28 is shown being connected or attached to the second tubular member 14 by use of an adhesive 48. It is also possible and contemplated that the valve 28 may be connected or attached to the second tubular member 14 in any other suitable manner such as being heat sealed, or by using screws, bolts, pegs, tabs, or a combination thereof. Although not shown, it is possible that the duckbill valve 40 may have a flange that is used to connect or attach the duckbill valve 40 to the second tubular member 14. As can be appreciated, a liquid, such as water, may be drawn up through the inlet end 42, the central body portion 44, the outlet end 46, and through the second tubular member 14. However, due to the construction of the duckbill valve 40, any liquid within the second tubular member 14 is blocked from flowing out of the inlet end 42. In essence, the duckbill valve 40 allows free flow of a liquid with positive differential pressure and blocks free flow of a liquid with negative differential pressure. The duckbill valve 40 is shown only for purposes of example. As has been previously indicated, any one-way valve may be used that allows a liquid to flow into the second tubular member 14 and prevents or blocks a liquid from flowing out of the closed end 26 of the second tubular member 14.

Figure 5:
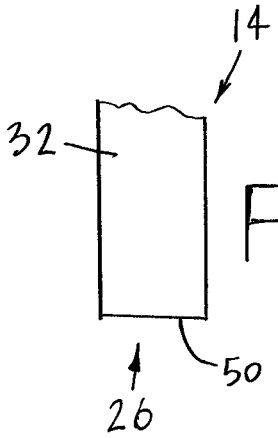
FIG. 5 is a partial perspective view of a closed end of a tubular member constructed according to the present disclosure.

Referring now to FIG. 5, a partial perspective view of the closed end or closed end portion 26 of the second tubular member 14 is shown. The closed end 26 has a flat end 50. The flat end 50 may be a cap portion or may be formed as part of the second tubular member 14. The second tubular member 14 also has the exterior surface 32.

Figure 6:
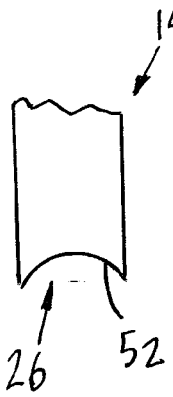
FIG. 6 is a partial perspective view of another closed end of a tubular member constructed according to the present disclosure.

FIG. 6 depicts another partial perspective view of the closed end 26 of the second tubular member 14. The closed end 26 is shown having a concave end 52. In this particular configuration, less liquid may be held or stored within the second tubular member 14. A player may find that having less liquid within the second tubular member 14 may enhance musical notes that are produced by the musical instrument 10.

Figure 7:
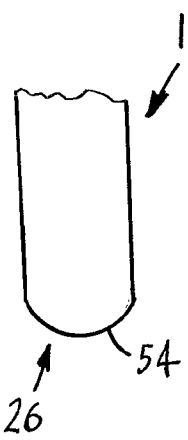
FIG. 7 is a partial perspective view of another closed end of a tubular member constructed according to the present disclosure.

With reference now to FIG. 7, another partial perspective view of the closed end 26 of the second tubular member 14 is illustrated. The closed end 26 is depicted having a convex or hemispherical end 54. With this configuration it is possible to have more liquid stored in the second tubular member 14.

Figure 8:
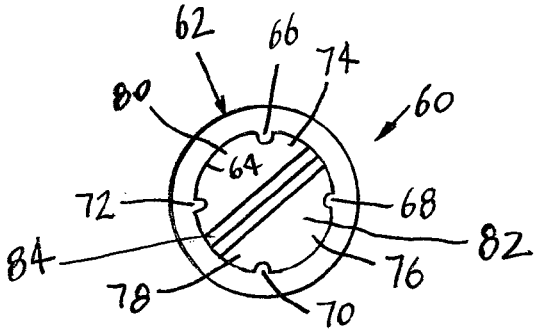
FIG. 8 is a cross-sectional view of an inlet end view of another embodiment of a tubular member constructed according to the present disclosure.

FIG. 8 illustrates a cross-sectional view of another embodiment of a second tubular member 60. The second tubular member 60 an exterior surface 62, an interior surface 64, and centering ribs or nubs 66, 68, 70, and 72 along the interior surface 64. The centering nubs 66, 68, 70, and 72, along with the stopper 34 (not shown in this view), are used for centering the first tubular member 12 (also not shown in this view) when the first tubular member 12 is inserted into the second tubular member 60. The exterior surface 22 (not shown in this view) of the first tubular member 12 will be in contact with the centering nubs 66, 68, 70, and 72. Liquid (not shown) will be able to fill in the spaces or pockets 74, 76, 78, and 80 formed between the nubs 66, 68, 70, and 72 and the exterior surface 22 of the first tubular member 12. Although four centering nubs 66, 68, 70, and 72 are shown, it is also possible to have more nubs or less nubs. Further the nubs 66, 68, 70, and 72 may extend the entire length of the second tubular member 60 or only extend a portion of the length of the second tubular member 60. The second tubular member 60 also has a closed end 82 having a one-way valve 84. As can be appreciated, the one-way valve 84 allows a liquid to be drawn up through the second tubular member 60 so that the member 60 functions as a straw for drinking purposes.

Figure 9:
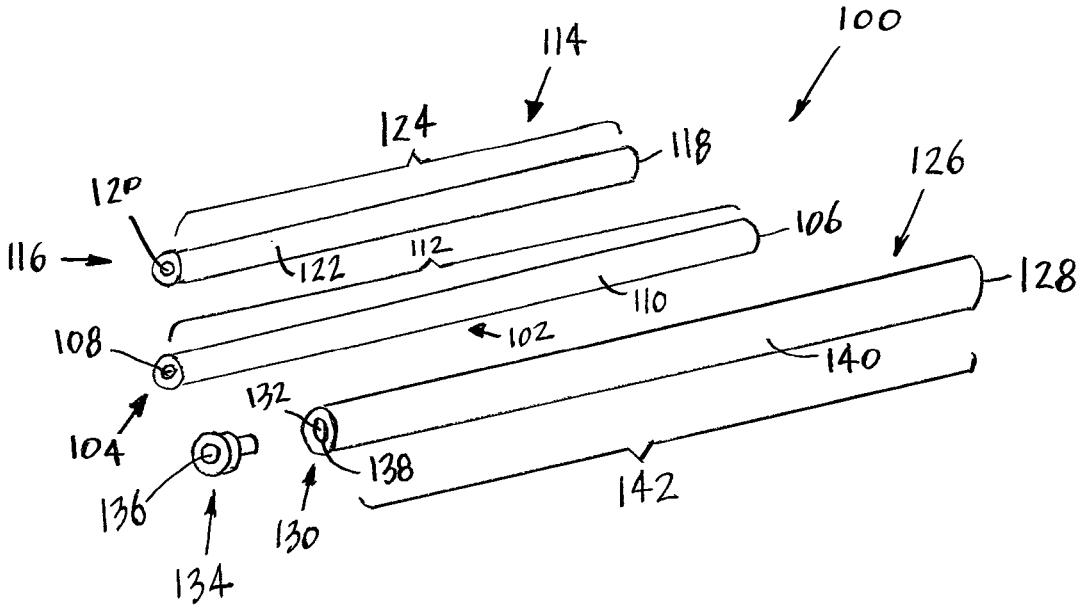
FIG. 9 is a perspective view of another embodiment of a musical instrument constructed according to the present disclosure shown in a disassembled state.

With reference to FIG. 9, another embodiment of a musical instrument 100 is shown. The musical instrument 100 comprises a first tubular member 102 having an inlet end 104, an outlet end 106, an interior surface 108, an exterior surface 110, and a first length 112. The musical instrument 100 also comprises a second tubular member 114 having an inlet end 116, an outlet end 118, an interior surface 120, an exterior surface 122, and a second length 124. The first length 112 may be greater than the second length 124. The musical instrument 100 further comprises a third tubular member 126 having an inlet end 128 and a closed end 130 having a one-way valve 132. The musical instrument 100 also has a stopper 134 having an opening 136 with the stopper 134 being inserted into the inlet end 128 of the second tubular member 126. The opening 136 is used to receive either the first tubular member 102 or the second tubular member 114 there through. The stopper 134 is used to form a closed container formed by the stopper 134, the third tubular member 126, and the closed end 130. The third tubular member 126 also has an interior surface 138 and an exterior surface 140. The closed end 130 of the third tubular member 126 is used to stop or restrict movement of either the first tubular member 102 or the second tubular member 114. As can be appreciated, the first tubular member 102 having the first length 112 may be capable of playing different sounding musical notes or tones than the second tubular member 114 having the second length 124. In this manner, a player of the musical instrument 100 may change out the tubular members 102 and 114 depending upon what notes or tones are to be played or produced. The third tubular member 126 also has a length 142. The first length 112 may be larger than the length 142 and the second length 124 may be smaller than the length 142.

The closed end 130 allows the third tubular member 126 to hold or store a liquid, such as water, when the first tubular member 102 or the second tubular member 114 is inserted therein. The one-way valve 132 also allows water to flow through the valve 132, and out either the inlet end 106 or the inlet end 118. In essence, the musical instrument 100 may function as both a straw and the musical instrument 100. Further, when a liquid is placed in the third tubular member 126 and the first tubular member 102 or the second tubular member 114 is inserted therein, the musical instrument 100 may be operated or played. The musical instrument 100 may also be operated without any liquid being placed in the third tubular member 126. In particular, the first tubular member 102 or the second tubular member 114 may be moved relative to the third tubular member 126 by sliding the first tubular member 102 or the second tubular member 114 up and down and by a player blowing air by or into the inlet ends 104 or 116 to produce a musical note. By moving the first tubular member 102 or the second tubular member 114 relative to the third tubular member 126 various other musical notes may be generated or produced. The first tubular member 102 or the second tubular member 114 are also centered within the third tubular member 126 by the stopper 134. As has been previously discussed, the musical instrument 100 may function as a musical instrument without any liquid being in the third tubular member 126. Air blown by or into either of the inlet ends 104 or 116 will produce or generate a sound or note.

The length 112 of the first tubular member 102 may be longer or greater than the length 142 of the third tubular member 126. This allows the first tubular member 102 to extend out of the inlet end 128 of the third tubular member 126. By way of example only, the length 112 may be a half inch greater than the length 142. Also, the length 124 of the second tubular member 114 may be shorter or less than the length 142 of the third tubular member 126. It is also possible that the length 124 may be equal to the length 142. The first tubular member 102 has a diameter and the third tubular member 126 has a diameter. As can be appreciated, the diameter of the first tubular member 102 is less than the diameter of the third tubular member 126. This allows the first tubular member 102 to fit within the third tubular member 126. The second tubular member 114 also has a diameter that is less than the diameter of the third tubular member 126. The diameters of the first tubular member 102, the second tubular member 114, and the third tubular member 126 are shown to be circular in shape or cross-section. Although not shown, it is also possible that the third tubular member 126 may be constructed having the centering nubs 66, 68, 70, and 72. Further, the closed end 130 may take on any form such as a concave end, a convex end, or a flat end, as has been previously described with reference to the closed end 26.

Figure 10:
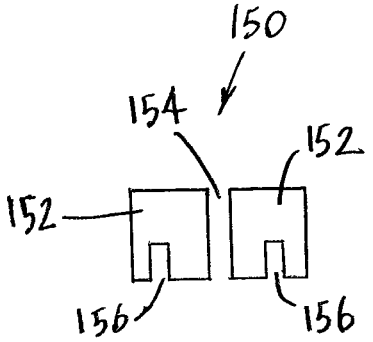
FIG. 10 is a cross-sectional view of a stopper member constructed according to the present disclosure.

FIG. 10 depicts a cross-sectional view of another embodiment of a stopper member 150 constructed according to the present disclosure. The stopper member 150 comprises a body 152 having an opening 154 formed therein and a circular indentation 156. The circular indentation 156 is adapted for allowing the inlet end 24 of the second tubular member 12 to fit therein. The stopper member 150 may be adhered to the inlet end 24 or connected or secured in any suitable manner. The opening 154 may be centrally located or may be offset from center of the stopper member 150. The stopper member 150 may be constructed of any suitable material such as rubber, plastic, or any other polymer.

Preferably, the musical instruments 10 and 100 will be constructed of a relatively lightweight material so that it can be easily handled and played. By way of example only, the musical instruments 10 and 100 may be constructed of a tubing such as PVC (polyvinyl chloride) tubing, wood, metal, polymer clay, plastic, glass, carbon fiber, or ceramic. The first tubular member 12 and the second tubular member 14 and the first tubular member 102, the second tubular member 114, and the third tubular member 126 may be straight to facilitate a smooth motion when moving the first tubular member 12 relative to the second tubular member 14 or the first tubular member 102 or the second tubular member 114 relative to the third tubular member 126. Although the tubular members 12, 14, 102, 114, and 126 have been depicted having a circular cross-section, it is also possible that the cross-sections may take on other shapes. Again, by way of example only, an oval cross-section, an egg shaped cross-section, or a rectangular cross-section may be used. It is also contemplated that the tubular members 12, 14, 102, 114, and 126 may be clear, colored, or have a pattern or a logo printed thereon or incorporated therein.

From all that has been said, it will be clear that there has thus been shown and described herein a musical instrument which fulfills the various objects and advantages sought therefor. It will be apparent to those skilled in the art, however, that many changes, modifications, variations, and other uses and applications of the subject musical instrument are possible and contemplated. All changes, modifications, variations, and other uses and applications which do not depart from the spirit and scope of the disclosure are deemed to be covered by the disclosure, which is limited only by the claims which follow.

What is claimed is:

1. A musical instrument comprising:

a first tubular member having an inlet end and an outlet end, an interior surface, and an exterior surface;

a second tubular member having an inlet end and a closed end having a one-way valve, the second tubular member adapted for receiving the first tubular member for moving the first tubular member relative to the second tubular member, and the second tubular member for receiving a liquid through the one-way valve; and a stopper having an opening, the stopper for being inserted in the inlet end of the second tubular member and the opening for receiving the first tubular member there through for moving the first tubular member relative to the stopper.

2. The musical instrument of claim 1 wherein the first tubular member has a length and the second tubular member has a length with the length of the first tubular member being greater than the length of the second tubular member.

3. The musical instrument of claim 1 wherein the first tubular member has a length and the second tubular member has a length with the length of the first tubular member being smaller than the length of the second tubular member.

4. The musical instrument of claim 1 wherein the first tubular member has a diameter and the second tubular member has a diameter with the diameter of the second tubular member being greater than the diameter of the first tubular member.

5. The musical instrument of claim 1 wherein the one-way valve is a duckbill valve.

6. The musical instrument of claim 1 wherein the stopper member further comprises a body having a circular indentation formed therein with the circular indentation for receiving the inlet end of the second tubular member.

7. A musical instrument comprising:

a first tubular section having an inlet end and an outlet end, an interior surface, and an exterior surface;

a first tubular member having an inlet end and a closed end portion having a one-way valve positioned at the closed end portion, the first tubular member adapted for receiving the first tubular section for moving the first tubular section relative to the first tubular member to generate a musical note when air is blown by the inlet end of the first tubular section, and the one-way valve for allowing a liquid to be drawn into and through the first tubular member; and a stopper having an opening, the stopper for being inserted on the inlet end of the first tubular member and the opening for receiving the first tubular member there through for moving the first tubular section relative to the stopper.

8. The musical instrument of claim 7 wherein the closed end portion is flat.

9. The musical instrument of claim 7 wherein the closed end portion is convex in shape.

10. The musical instrument of claim 7 wherein the closed end portion is concave in shape.

11. The musical instrument of claim 7 wherein the closed end portion is hemispherical in shape.

12. The musical instrument of claim 7 wherein the one-way valve is a duckbill valve.

13. The musical instrument of claim 7 wherein the stopper further comprises a body having a circular indentation formed therein with the circular indentation for receiving the inlet end of the second tubular member.

14. The musical instrument of claim 7 wherein the first tubular section has a diameter and the first tubular member has a diameter with the diameter of the first tubular member being greater than the diameter of the first tubular section.

15. The musical instrument of claim 7 wherein the stopper is constructed of rubber.

16. A musical instrument comprising:

a first tubular member having an inlet end, an outlet end, and a first length;

a second tubular member having an inlet end, an outlet end, and a second length with the second length being different than the first length;

a third tubular member having an inlet end and a closed end having a one-way valve, the third tubular member adapted for receiving the first tubular member or the second tubular member for moving the first tubular member or the second tubular member relative to the third tubular member, and the one-way valve for allowing a liquid to be drawn into the third tubular member; and a stopper member having an opening, the stopper for being inserted on the inlet end of the third tubular member and the opening for receiving the first tubular member or the second tubular member there through for moving the first tubular member or the second tubular member relative to the stopper.

17. The musical instrument of claim 16 wherein the stopper member further comprises a body having a circular indentation formed therein with the circular indentation for receiving the inlet end of the third tubular member.

18. The musical instrument of claim 16 wherein the third tubular member has a length which is less than the length of the first tubular member.

19. The musical instrument of claim 16 wherein the one-way valve is a duckbill valve.

20. The musical instrument of claim 16 wherein the stopper member is constructed of rubber.

* * * * *